US006490949B2

(12) United States Patent
Simpson

(10) Patent No.: US 6,490,949 B2
(45) Date of Patent: Dec. 10, 2002

(54) RULE FOR A CUTTING DIE

(75) Inventor: Jack R. Simpson, Raleigh, NC (US)

(73) Assignee: Container Graphics Corporation, Cary, NC (US)

( * ) Notice: Subject to any disclaimer, the term of this patent is extended or adjusted under 35 U.S.C. 154(b) by 0 days.

(21) Appl. No.: 09/737,322

(22) Filed: Dec. 14, 2000

(65) Prior Publication Data

US 2002/0073805 A1 Jun. 20, 2002

(51) Int. Cl.[7] ..... B21K 5/20
(52) U.S. Cl. ..... 76/107.8; 76/107.1
(58) Field of Search ..... 76/101.1, 119, 76/107.8; 83/685, 663, 698.41; 428/68; 30/107.1

(56) References Cited

U.S. PATENT DOCUMENTS 4,103,580 A * 8/1978 Sauer et al. ..... 83/663
4,248,117 A * 2/1981 Bugnone ..... 83/863
5,143,768 A * 9/1992 Wilderman et al. ..... 428/68
5,566,594 A * 10/1996 Michlin ..... 76/107.8
5,943,935 A * 8/1999 Brayton et al. ..... 86/685

* cited by examiner

*Primary Examiner*—Hwei-Siu Payer
(74) *Attorney, Agent, or Firm*—Coats & Bennett, P.L.L.C.

(57) ABSTRACT

A rule for use in conjunction with a cutting die and adapted to be received within an elongated slit formed in a die board. The rule includes an upper edge and a lower edge, and a main body extending between the lower and upper edges. A series of notches are generally uniformly formed and spaced about a lower portion of the rule such that the respective notches effectively extend through the lower edge of the rule and are open along the lower edge of the rule. The series or group of notches function to facilitate the curving of the rule and further function to bridge certain uncut sections of the die board that exist within one or more slits formed in the die board.

10 Claims, 3 Drawing Sheets

RULE FOR A CUTTING DIE

FIELD OF THE INVENTION

The present invention relates to rules used in conjunction with die boards and more particularly to a rule design having a group of notches formed in the lower portion thereof where the notches serve to bridge portions or sections of the die board.

BACKGROUND OF THE INVENTION

Various types of rules are customarily used in cutting dies. In the way of examples, these rules may include perforating, scoring or cutting rules. In any event, these rules are typically inserted within slits formed in a die board that forms a part of a cutting die. Typically a die board is designed such that it extends over a cylinder or plate structure and these slits extend completely through the die board such that once a rule is inserted therein, the rule may in fact engage the underlying cylinder or plate structure. In order to keep the die board together and prevent the die board from falling apart like a puzzle, it is customary to leave sections of the slit uncut. It is appreciated that the rules will have to be notched in order that they might be able to bridge these uncut sections within the slits. To deal with this, it is customary for a die maker to cut bridging notches in the lower portion of the rules before inserting them into the respective slits of the die board. That is, the die maker will typically measure the slits and determine precisely the locations of the uncut sections within the slits that have to be bridged. Once this is done, then the die maker will proceed to cut bridging notches in the lower portions of the rule such that the bridging will appropriately line-up with the uncut sections that lie in the slits of the die board. However, it is no small undertaking to cut bridge notches in a set of rules. Indeed, it is not unusual for a typical rotary die board used for cutting corrugated board, for example, to include 700 inches of rule and approximately 200 individual bridges or notches formed in the rule. Not only are there many notches to be cut, but each individual notch or bridge requires substantial time and effort on the die maker's part. Cutting bridge notches in rules is for the most part a laborious manual operation that requires a substantial amount of time and effort. Furthermore, in cutting bridge notches in rules, the bridge notch usually is formed in a square or rectangular configuration. When such bridge notches are introduced into the rule, there is also introduced new stress points about the upper corners of the bridge notches.

Further, it should be appreciated that in the case of rotary die cutting machines, the die board assumes a generally arcuate or curved configuration. Accordingly, it is not unusual for the rules, whether they be perforating, scoring or cutting rules, to be curved or arcuate shaped. To facilitate the curving of these rules, it is common practice to cut very small notches in the lower portion of rules prior to the rules actually being curved. That is, the rules are ordinarily fabricated in a straight configuration. Thereafter, the small notches are formed in the lower portion of the rules and thereafter the rules are curved. The presence of the small notches in the lower portion of the rules generally facilitates the curving of the rules.

SUMMARY OF THE INVENTION

The present invention entails a rule for a cutting die that includes preformed bridging notches that are generally uniformly spaced to span uncut sections of slits formed in a die board. More particularly, the rule includes an upper edge, lower edge, and a main body extending between the upper and lower edges. The bridging notches extend through the lower edge into the main body of the rule. Consequently, the bridge notches are opened from the bottom or along the lower edge of the rule.

The bridge notches may form any one of a number of functions. First, the notches may facilitate the formation of a curved rule. That is, in forming a curved or arcuate-shaped rule, that process or method begins with forming a straight or horizontal rule and then curving the rule. By forming notches within the lower portion of the straight rule, the straight rule is easier to curve.

Secondly, these rules are designed to fit within the slits cut within a die board of a cutting die. Because the slits are normally open to an underlying cylinder or plate, for example, it is important that sections within the slits remain uncut so as to hold the die board together and keep the die board from falling apart like a puzzle. However, these uncut sections appearing at intervals within a slit must be bridged or spanned when the rule is inserted therein. Thus, these bridging notches formed in the lower portion of the rule function to span the uncut sections that lie at selective intervals along the slits.

Other objects and advantages of the present invention will become apparent and obvious from a study of the following description and the accompanying drawings which are merely illustrative of such invention.

DETAILED DESCRIPTION OF THE INVENTION

Figure 1:
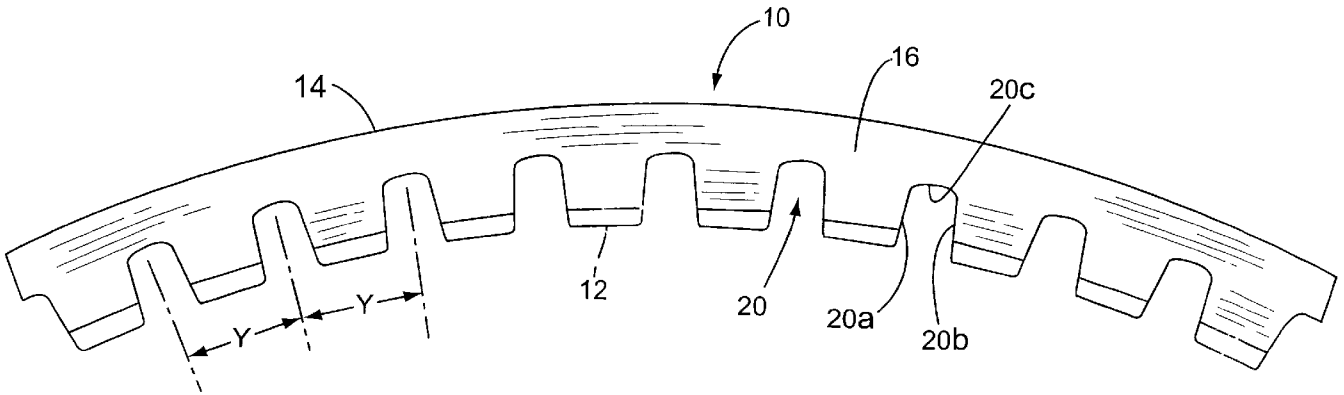
FIG. 1 is a side elevational view of a curved rule formed in accordance with the present invention.
Figure 2:
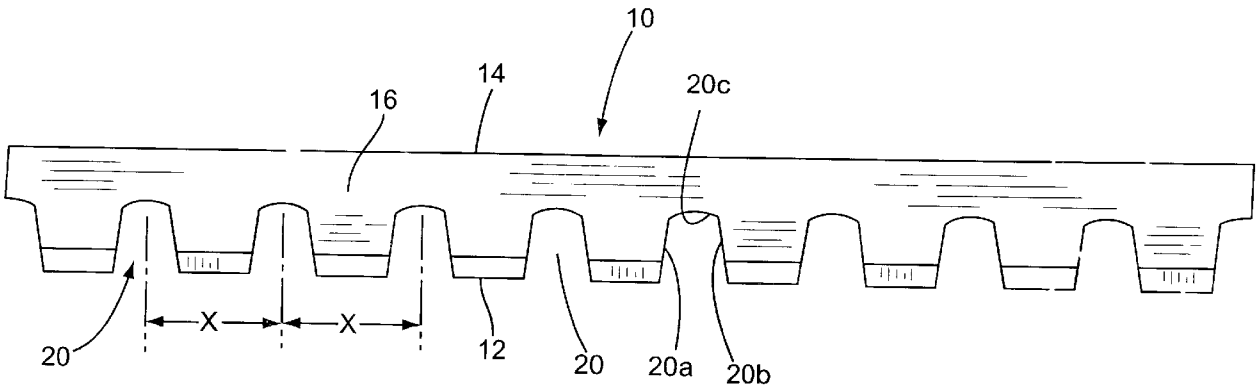
FIG. 2 is a side view of a straight rule formed in accordance with the present invention.
Figure 3:
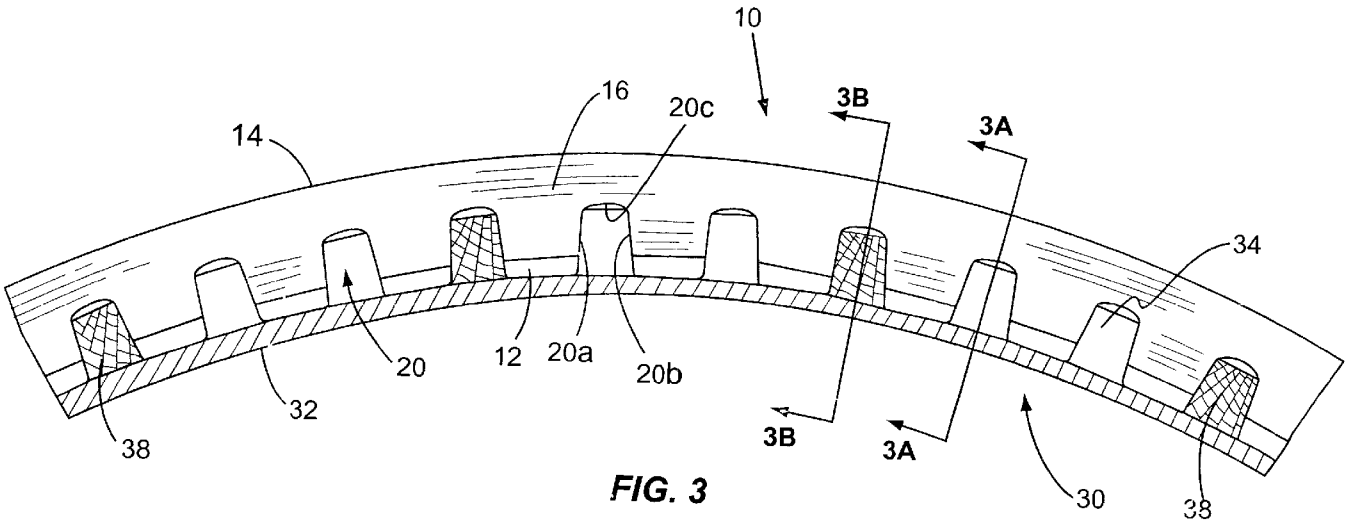
FIG. 3 is a cross-sectional view of a cutting die showing a curved rule inserted within a slit within the cutting die.

With further reference to the drawings, particularly FIGS. 1–4, the rule of the present invention is shown therein and indicated generally by the numeral 10. It will be appreciated that rule 10 is designed to be inserted within a cutting die of the type utilized to cut, score or perforate corrugated board. While the rule 10 is shown in FIG. 3 as forming a part of a rotary cutting die, it should be appreciated that the rule 10 of the present invention could be employed within a flat cutting die. As will be appreciated by those skilled of the art, such cutting dies typically include cutting rules, scoring or creasing rules, or perforating rules. Therefore, as used herein, the term "rule" means any type of rule used in a cutting die and would, of course, include cutting rules, scoring or creasing rules, and perforating rules.

Viewing rule 10 in more detail, it is seen that the same includes a lower edge 12 and an upper edge 14. To facilitate the insertion of rule 10 into a die board, the lower edge 12 of the rule is tapered. The tapered lower edge facilitates the insertion of the rule into a saw cut or laser cut slit formed in the die board. Extending between the lower edge 12 and the upper edge 14 is a main body portion indicated by the numeral 16. As illustrated in FIGS. 1 and 2, the rule 10 can assume a curved or arcuate-shaped configuration (FIG. 1) or a generally straight or horizontal configuration (FIG. 2).

Formed in the lower portions of the rule 10 are a series of notches indicated generally by the numeral 20. Each notch 20 includes a pair of opposed sides 20*a* and 20*b* and an arcuate or curved shaped top portion 20*c*. The curved-shaped top portion 20*c* of each notch enables the upper portion of the notch to easily seat on and around a bridge or uncut section of the slit formed in the die board. That is, as the rule 10 is inserted within the slit, the arched or curved-shaped top portion 20*c* may along certain portions thereof actually engage or cut into the underlying uncut section formed in the slit.

The notches 20 formed in the rule 10 are generally uniformly spaced. For example, in the case of the straight or horizontal rule 10 shown in FIG. 2, the individual notches are spaced, on center, the distance X which in one embodiment of the present invention is contemplated to be approximately in the range of ¾–1⅛ inches. In one specific embodiment it is contemplated that the notches 20 would be spaced, on center, a distance of approximately ¾–1 inch. The curved or arcuate shaped rule shown in FIG. 1 in a contemplated embodiment would include notches spaced approximately the same distance apart. That is, in the case of the curved rule shown in FIG. 1, the notches 20 are spaced, on center, an arcuate or curved distance Y. This arcuate or curved distance Y may vary from one application to another but again it is contemplated that in many applications the arcuate distance Y would be approximately ¾–1⅛ inches. In one specific embodiment it is contemplated that this arcuate or curved distance Y would be approximately ¾–1 inch.

The notches 20 formed in the rule 10 are referred to as preformed notches. By "preform" it is meant that the notches 20 are formed in the rule 10 during the manufacturing or fabricating process. This is to be contrasted with the notches being formed by a die maker during the course of fabricating or constructing a cutting die.

Notches 20 formed in the rule 10 perform one or more functions. For example, the notches 20 facilitate the forming of curved rules such as that shown in FIG. 1. That is, the process or method for fabricating or forming a curved rule for use in conjunction with a rotary cutting die, entails first forming the rule in a straight or horizontal configuration such as illustrated in FIG. 2. After the rule has been formed into the straight configuration, then the rule is placed in a bending machine designed to bend the same into a curve shape such as shown in FIG. 1. The presence of the notches 20 formed in the lower portion of the rule 10 greatly facilitates the curving of the rule.

Figure 4:
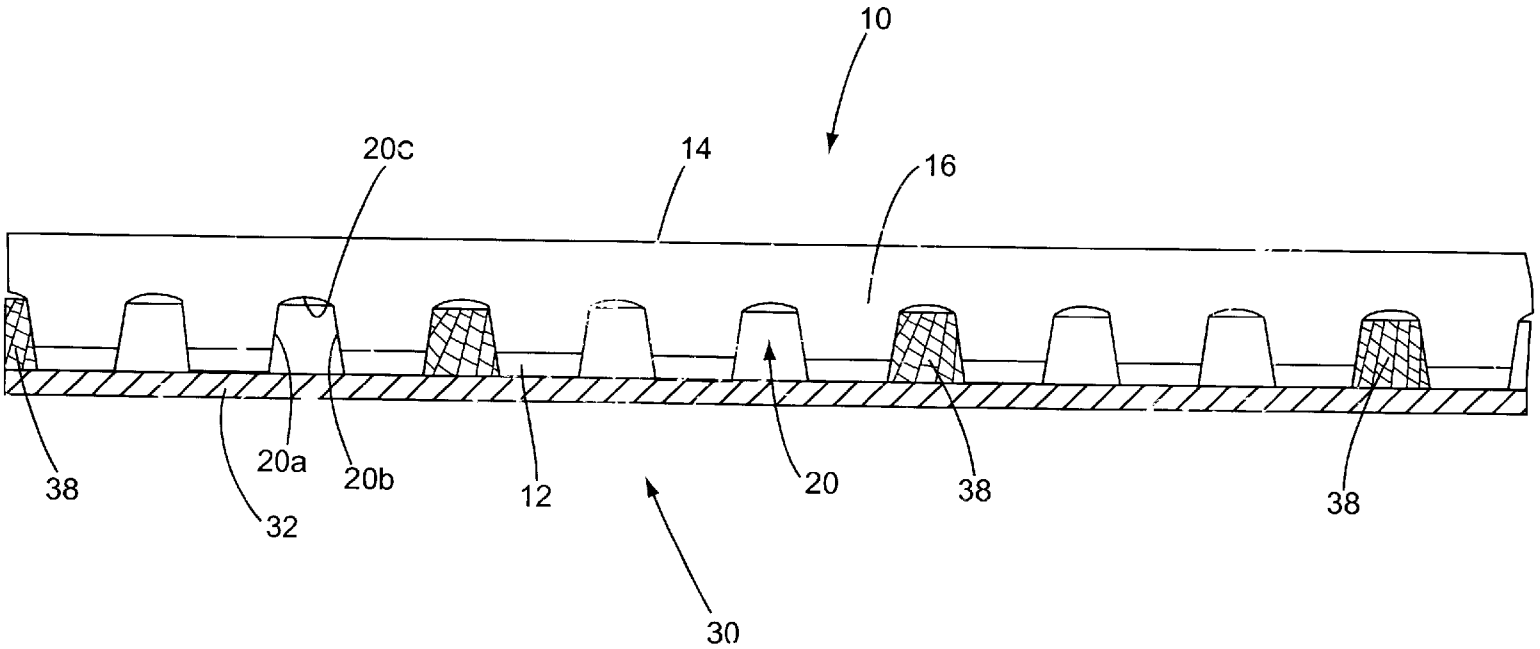
FIG. 4 is a cross-sectional view of a cutting die showing a horizontal rule inserted within a slit within the cutting die.

A second function or application of the notches 20 comes into play when the rule 10 is inserted into a cutting die. Before discussing this application of the rule 10, it may be beneficial to briefly review the structure of conventional cutting dies. With reference to FIGS. 3 and 4, there is shown therein a portion of a cutting die and the portion of the cutting die is indicated generally by the numeral 30. Typically, a rotary cutting die will be mounted on an upper cylinder 32 which is sometimes referred to as a die cylinder. Mounted on the upper cylinder 32 is a die board 34 that is typically formed of laminated wood and assumes a generally cylindrical shape, in the case of a rotary die, to conform with the outer surface of the upper cylinder 32.

Although not specifically shown herein, a conventional cutting die of the rotary type would also include a lower anvil that would lie below and in close proximity to the upper cylinder 32 and the die board 34. Details of a complete cutting die are not dealt with here in detail because such is not per se material to the present invention. However, for a more unified and complete understanding of cutting dies, especially dies used for cutting, scoring and perforating corrugated board, one is referred to in the disclosure in U.S. Pat. No. 5,636,559 and the disclosure found in U.S. patent application Ser. No. 09/054,564, filed Apr. 3, 1998. These two disclosures are expressly incorporated herein by reference.

Figure 3B:
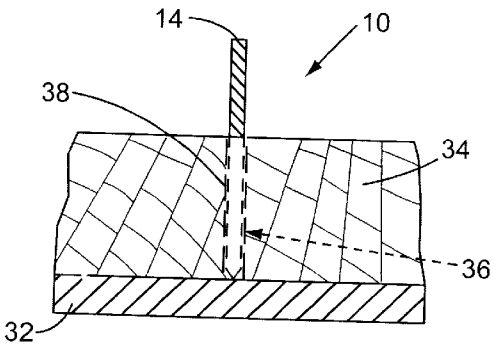
FIG. 3B is a cross-sectional view taken through the line 3B—3B of FIG. 3.
Figure 3A:
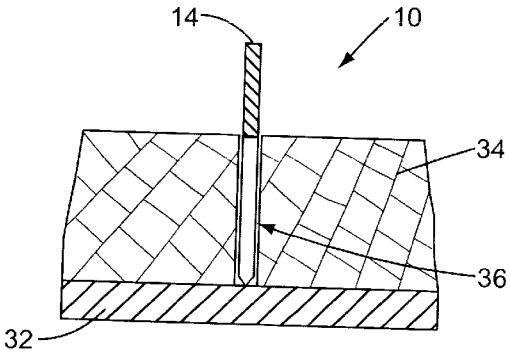
FIG. 3A is a cross-sectional view taken through the line 3A—3A of FIG. 3.

Turning to FIGS. 3 and 4, it is seen that the die board 34 is shown mounted on an upper cylinder 32. In order to provide means for enabling various types of rules to be inserted within the die board 34, it is conventional to cut a series of slits 36 (FIGS. 3A and 3B) into the die board 34 for receiving and holding various types of rules such as those shown in FIGS. 1 and 2. The slits 36 are in reality saw cuts or laser cuts that form kurf lines in the die board 34. It will be appreciated, that a reference to a slit 36 is essentially referring to conventional saw cut or laser cut kurf lines formed in the die board. As noted above, these slits for receiving the rules 10 are typically cut completely through the die board 34 such that the lower edge 12 of the rules may rest or engage the underlying upper cylinder 32. However, as is conventional, to prevent the die board 34 from falling apart like a puzzle, at certain intervals along the slit, sections of the die board are left uncut. These uncut sections or bridges are shown in FIGS. 3 and 4 and referred to by the numeral 38.

In cutting the slits 36 within the die board 34, the die maker will space the uncut sections 38 a certain distance apart. In the case of the present invention, the uncut sections 38 will be particularly spaced to coincide with the notches 20 formed in the rule 10. In the case of FIG. 3, for example, and the curved rule 10 shown therein, it is seen that the uncut sections 38 are spaced such that the uncut sections 38 are bridged by every third notch 20 formed in the rule 10. It is appreciated, that this spacing relationship could vary. The advantages of this system and method should become readily apparent. For a given set of rules 10 with a standard or consistent notch spacing, the die maker can cut slits throughout the die board 34 in such a fashion that the uncut sections or bridges 38 appearing along the slits are spaced such that the notches formed in the rules will automatically bridge the uncut sections 38 when the rules are inserted within the slits of the die board. Again, this does not mean that there is a one-to-one relationship between the uncut sections 38 and the notches 20 formed in the rules 10. It may well be, as illustrated in FIGS. 3 and 4, that there are more notches 20 than uncut sections or bridges 38. But in any event the spacing arrangement is such that once the rules 10 are inserted into the slits of the die board 34 that the notches 20 are spaced such that they will coincide with the uncut sections 38 and bridge them without the die maker having to custom form the notches in the rules.

Another advantage of the present invention is that the notched rule can effectively be used as measuring instrument to facilitate the insertion of a notched rule into a slit formed in a die board. Assume, for purposes of explanation, that a particular rule is to be inserted within a slit and at some point is to be bent in order to make a turn in the slit. The technician or die marker can simply look at the slit and the number of uncut sections or bridges that lie within the slit and with that information can view the rule and count the number of notches and identify the point on the rule where the bend is to be placed. This will enable the technician or the die maker to quickly and efficiently install rules within die boards.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

I claim:

1. A method of forming a cutting die, comprising: preforming a plurality of spaced apart bridge notches along a rule; forming a slit in a die board and spacing a plurality of bridges along the slit; spacing the bridges along the slit such that the spacing of the bridges along the slit conform with the spacing of the bridge notches in the rule; inserting the rule within the slit such that the bridges along the slit align with one or more preformed bridge notches of the rule; wherein when the rule is inserted each bridge along the slit lies within a preformed bridge notch of the rule; and spacing at least some of the bridges along the slit further apart than the bridge notches of the rule such that when the rule is inserted into the slit, one or more bridge notches will lie between certain bridges formed along the slit.

2. The method of claim 1 including spacing the bridges along the slit such that the bridges will register with certain bridge notches in the rule that are spaced approximately ¾–1⅛ inches apart.

3. The method of claim 1 wherein the slit is formed by cutting the die board and wherein the bridges are formed by extending the cut for a selected length along the die board, terminating the cut for a selected distance along the die board, and then resuming the cut.

4. A cutting die comprising:

a die board;

at least one slit formed in the die board;

the slit including a series of spaced apart bridges formed along the slit;

at least one rule adapted to be inserted within the slit and including a plurality of preformed and spaced apart bridge notches formed along the rule;

wherein the bridges formed along the slit are spaced apart a distance that correspond to the spacing of the preformed bridge notches formed in the rule such that when the rule is inserted into the slit in the die board, the bridges formed along the slit will align with one or more preformed bridge notches formed in the rule; and wherein at least some of the bridges formed along the slit are spaced apart a distance greater than the spacing between consecutive preformed bridge notches in the rule such that when the rule is inserted within the slit, the bridges formed along the slit will not register with all the bridge notches formed in the rule.

5. The cutting die of claim 4 wherein the bridge notches of the rule are spaced apart approximately ¾–1⅛ inches apart.

6. The cutting die of claim 4 wherein the rule is selected from the group including a perforating rule, a scoring rule, and a cutting rule.

7. The cutting die of claim 4 wherein the bridge notches are uniformly spaced along the rule.

8. The cutting die of claim 4 wherein the rule is manufactured in a straight configuration and then curved to form a curved shape rule.

9. The cutting die of claim 4 wherein the slit formed within the die board is formed by a cut made in the die board and wherein the bridges are formed along the slit by extending the cut for a selected distance along the die board, terminating the cut for a selected distance along the die board, and then resuming the cut.

10. A cutting die comprising:

a die board;

at least one slit formed in the die board;

the slit including a series of spaced apart bridges formed along the slit;

at least one rule adapted to be inserted within the slit and including a plurality of preformed and spaced apart bridge notches formed along the rule;

wherein the bridges formed along the slit are spaced apart a distance that correspond to the spacing of the preformed bridge notches formed in the rule such that when the rule is inserted into the slit in the die board, the bridges formed along the slit will align with one or more preformed bridge notches formed in the rule; and wherein each bridge notch of the rule includes a pair of opposed sides and a curved shape top portion.

* * * * *